US007323136B1

(12) United States Patent
Barrera et al.

(10) Patent No.: US 7,323,136 B1
(45) Date of Patent: Jan. 29, 2008

(54) CONTAINERLESS MIXING OF METALS AND POLYMERS WITH FULLERENES AND NANOFIBERS TO PRODUCE REINFORCED ADVANCED MATERIALS

(75) Inventors: Enrique V. Barrera, Houston, TX (US); Yildiz Bayazitoglu, Houston, TX (US)

(73) Assignee: William Marsh Rice University, Houston, TX (US)

( * ) Notice: Subject to any disclaimer, the term of this patent is extended or adjusted under 35 U.S.C. 154(b) by 684 days.

(21) Appl. No.: 10/182,081

(22) PCT Filed: Feb. 1, 2001

(86) PCT No.: PCT/US01/03325

§ 371 (c)(1),
(2), (4) Date: Nov. 18, 2002

(87) PCT Pub. No.: WO01/57284

PCT Pub. Date: Aug. 9, 2001

Related U.S. Application Data

(60) Provisional application No. 60/179,582, filed on Feb. 1, 2000.

(51) Int. Cl.
*B22F 9/02* (2006.01)

(52) U.S. Cl. ..... 419/5; 419/11; 148/558

(58) Field of Classification Search ..... 419/10, 419/11, 5

See application file for complete search history.

(56) References Cited

U.S. PATENT DOCUMENTS 2,686,864 A 8/1954 Wroughton et al.
4,389,361 A * 6/1983 Messerly ..... 264/108
4,463,606 A * 8/1984 Barmatz ..... 73/570.5
4,565,571 A 1/1986 Abbaschian
4,929,400 A * 5/1990 Rembaum et al. ..... 264/10
4,966,737 A * 10/1990 Werner et al. ..... 264/14
5,093,050 A * 3/1992 Tepic ..... 264/415
5,215,688 A * 6/1993 Williamson et al. ..... 264/14
5,275,229 A * 1/1994 Fishman et al. ..... 164/513
5,281,653 A * 1/1994 Thomann et al. ..... 524/490
5,288,555 A * 2/1994 Monette et al. ..... 428/375
5,374,801 A * 12/1994 Leung et al. ..... 219/121.36
5,420,081 A * 5/1995 Mattes et al. ..... 501/12
5,424,054 A * 6/1995 Bethune et al. ..... 423/447.2
5,500,493 A * 3/1996 Guigne et al. ..... 181/5
5,511,603 A * 4/1996 Brown et al. ..... 164/97
5,648,056 A * 7/1997 Tanaka ..... 423/445 B
5,750,615 A * 5/1998 Lukich et al. ..... 524/495

(Continued)

FOREIGN PATENT DOCUMENTS

WO WO01/57284 A1 * 8/2001

*Primary Examiner*—George Wyszomierski
(74) *Attorney, Agent, or Firm*—Robert C. Shaddox; Winstead PC

(57) ABSTRACT

The present invention relates to fullerene, nanotube, or nanofiber filled metals and polymers. This invention stems from a cross-disciplinary combination of electromagnetic and acoustic processing and property enhancement of materials through fullerene or nanofiber additives. Containerless processing (CP) in the form of electromagnetic field enduced and/or acoustic mixing leads to controlled dispersion of fullerenes, nanotubes, or nanofibers in various matrices. The invention provides methods of mixing that highly disperse and align the fullerenes, nanotubes, or nanofibers within the matrices of metals and polymers. The invention provides new compositions of matter and multifunctional materials based on processing, composition, and degree of in situ processing.

80 Claims, 6 Drawing Sheets

U.S. PATENT DOCUMENTS 5,759,725 A 6/1998 Hirao et al.
5,887,018 A * 3/1999 Bayazitoglu et al. ..... 373/139
6,034,883 A 3/2000 Tinney
6,057,637 A * 5/2000 Zettl et al. ..... 313/310
6,221,330 B1 * 4/2001 Moy et al. ..... 423/447.3
6,228,904 B1 * 5/2001 Yadav et al. ..... 523/210
6,250,984 B1 * 6/2001 Jin et al. ..... 445/51
6,265,466 B1 * 7/2001 Glatkowski et al. ..... 523/137
6,467,350 B1 * 10/2002 Kaduchak et al. ..... 73/570.5
6,471,929 B1 * 10/2002 Kusunoki et al. ..... 423/245.3
6,723,279 B1 * 4/2004 Withers et al. ..... 419/27

* cited by examiner

BOAT

CAN

An eight pole longitudinal electromagnetic levitator (a) Conventional conical levitator coil and (b) a longitudinal levitator coil.

(a) 200x (b) 200x

Optical micrographs for Al-Cu alloy (2 percent of copper). (a)Al-Cu alloy; (b)Al-Cu alloy with 0.3 percent nanotubes (in weight).

FIGURE 8
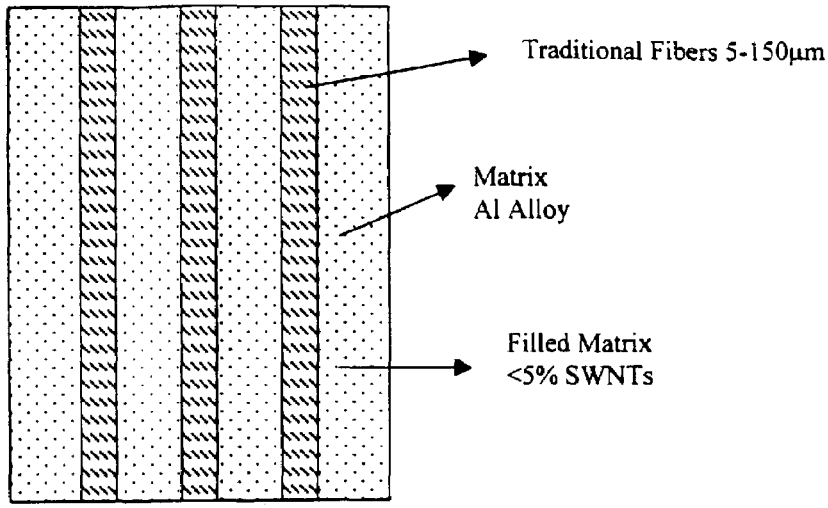
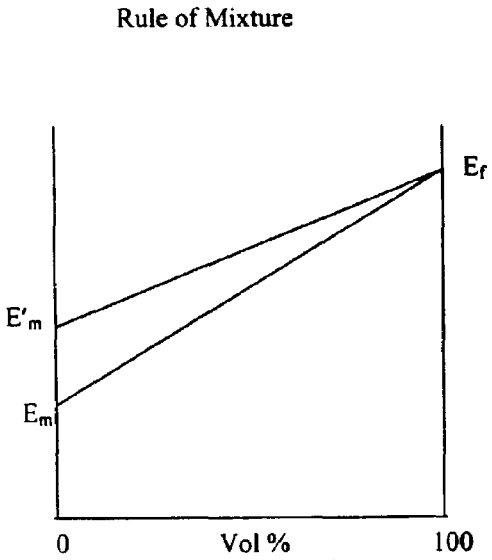
FIGURE 9a
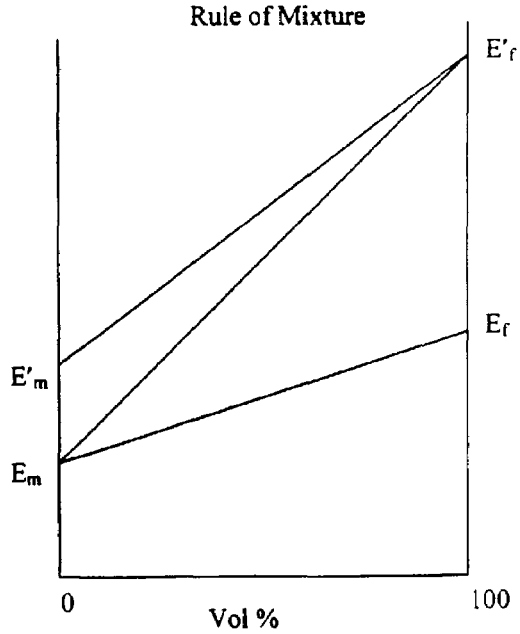
FIGURE 9b
Composite Concentration
High Content of Nanotubes
10-60 %
20-25 usually

CONTAINERLESS MIXING OF METALS AND POLYMERS WITH FULLERENES AND NANOFIBERS TO PRODUCE REINFORCED ADVANCED MATERIALS

RELATED APPLICATIONS

This application is a 35 U.S.C. § 371 national application of International Application Number PCT/US01/03325 filed on Feb. 1, 2001, which designated the United States, claiming priority to provisional application 60/179,582 filed on Feb. 1, 2000, and further, such applications are hereby incorporated herein by reference.

This invention was made with Government support under NSF Grants Nos. CTS-9312379 and DMR-9357505 awarded by the National Science Foundation and the Texas AdvancedTechnology Program, TATP Grant No. 003604-056. The Government may have certain rights in the invention.

BACKGROUND OF THE INVENTION

Field of the Invention

The present invention relates in general to the materials science field of composites, and more particularly to composites of dispersed nanotubes or nanofibers in a desired matrix. Even more specifically the present invention relates to a composite of highly dispersed or aligned fullerene nanotubes within a pure metal or metal alloy matrix and the process for making the same. The invention comprises at least three aspects: the composition of the composite material, the process for making the composite material, and an improved method for mixing or dispersing nanotubes in a matrix.

The invention relates to fullerene, nanotube, or nanofiber filled metals and polymers. Containerless processing (CP) in the form of electromagnetic field enduced and/or acoustic mixing leads to controlled dispersion of fullerenes, nanotubes, or nanofibers in various matrices. The invention provides methods of mixing that highly disperse and align the fullerenes, nanotubes, or nanofibers within the matrices of metals and polymers. The invention provides new compositions of matter and multifunctional materials based on processing, composition, and degree of in situ processing.

The levitation melting technique, that is the positioning of metal droplets by an electromagnetic force field, generated by induction coils of suitable geometry gained great popularity during the 1950's and 1960's. The principal attraction of the technique was that small electrically conducting samples could be melted and reacted in the absence of a solid container.

Levitation melting continues to gain prominence, for example electromagnetic force fields are ideal for the positioning of samples in space processing. A theoretical discussion and modeling of levitation melting is found in El-Kaddah and J. Szekely; The Electromagnetic Force Field, Fluid Flow Field and Temperature Profiles in Metal Droplets; Metallurgical Transactions; Volume 14B, pp. 404-410, September, 1984, hereby fully incorporated by reference.

Recent improvements in levitation designs have lead to the development of a levitator capable of suspending sizable specimens and capable of operating in either continuous or batch mode. The levitator comprises a generally cylindrical levitation zone formed by positioning a plurality of conductors longitudinally about an axis and passing alternating current in opposite directions through adjacent pairs of conductors. The levitator is formed by bending a single length of conductor into a plurality of longitudinal straight sections. In this manner, when current is passed through the conductor, a tunnel-shaped levitation zone having an opening at each end is formed. Specimens can be placed in the levitation zone individually or fed into the levitation zone through one end and removed from the opposite end. It is also possible to access the levitation zone through the side of the levitator. The levitator provides a strong levitation force with minimal heating in the specimen. The levitator can levitate even large specimens indefinitely without causing melting and/or boiling of the specimen. This longitudinal electromagnetic levitator is more fully described in U.S. Pat. No. 5,887,018, to Bayazitoglu, et al., and in Bayazitoglu and Shampine; Longitudinal Electromagnetic Levitator, Journal of Materials Processing & Manufacturing Science, Vol. 5-July 1996, pp. 79-91, both hereby fully incorporated by reference.

Containerless processing by acoustic levitation is also known. A survey of work done in acoustic and electromagnetic levitation is provided in Bayazitoglu; Containerless Processing by Acoustic and Electromagnetic Levitation; Heat Transfer 1998, Proceedings of the $11^{th}$ IHTC, Vol. 1, Aug. 23-28, 1998, pp. 115-129, hereby fully incorporated by reference.

Carbon nanotubes are the nanometer size fibers which have outstanding properties of mechanical strength, stiffness, high elongation and have high thermal and electrical conductivities. Efforts are ongoing to produce composite materials from these nanotubes. Development of these composites has been limited by an inability to mix the metal matrix with the nanotubes.

The desire to create "nanotube reinforced composites" is not new. However, the lack of reporting of this kind of work in the journals is evidence that no one has been able to produce these nanotube/metal composites with any kind of practical success. Previous attempts to create a dispersion of nanotubes in a matrix have been relative failures in that the systems are poorly dispersed, or not dispersed at all. Nanotubes are notorious for their entanglement. The problem of entanglement is a difficult problem to overcome in dispersing the nanotubes. At least part of the entanglement problem is associated with the form in which the nanotubes are available. In a dry state, the nanotubes come as a "bucky-paper" which is very hard to work with. The nanotubes can also come in a solution, usually in a toluene solvent. The SWNT usually are in the solution form The present invention can accommodate nanotube feed in either form.

The nanotubes have a tendency to clump or tangle, the solutions and other pretreatments initially loosen the tangles and allow some individual nanotubes to be freed permitting the mixing effect of the matrix flow induced by levitation to evenly distribute the nanotubes. The high shear that can be achieved under the teachings of the present invention should allow the mixing of nanotubes without the pretreatment. A large velocity gradient and high shear forces must be provided in order to liberate individual nanotubes from a clump or tangle. In addition, the time needed to de-tangle the nanotubes has heretofore been too great to allow practical use of known methods. If the liberation process takes too long, the nanotubes may begin to react with other components in the system. Hence, it is desired to provide a technique that disentangles nanotubes and effectively disperses them in a matrix in a short period of time and without causing or allowing destruction of the nanotubes. The present invention creates a dispersed matrix in very short times, typically less than one minute.

The present invention processes matrix composite materials with reinforcing carbon nanotubes using electromagnetic or acoustic levitation to achieve a high degree of mixing and homogenization. The nanotube reinforced materials have applications in various critical industries (aerospace, defense, medical, etc.) because of their unusual structural, transport, and mechanical properties, and their multifunctional properties.

SUMMARY OF THE INVENTION

A method of developing nanotube reinforced metals where a high degree of dispersion is achieved has been developed and has the potential to be scaled up to make a range of materials. This new composition of matter (nanotube filled matrices) is a multifunctional material based on processing, composition, and degree of in situ processing. Containerless processing (CP) in the form of electromagnetic field enduced mixing leads to controlled dispersion of nanotubes in various metal matrices and this is a new use for this processing/manufacturing method. Both stable nanotube systems and in situ processed reinforcements, where nanotubes act as precursors for new dispersed particles are achieved. A range of processing routes are at hand: Some examples by way of illustration are: 1) Molten metals can be levitated and nanotubes can be added on demand, (2) Canned powder/nanotube mixtures can be levitated, melted and mixed to desired dispersion levels, (3) Green compacts of metal powder/nanotubes can be precursor systems for achieving preferred mixing and dispersion, (4) Metal/alloy matching with nanotube additions can be used to achieve in situ processed new reinforcements where the fullerenes and nanofibers act as precursors, and (5) Scale up and coil shape development can lead to achieving aligned highly dispersed nanotubes and in situ reinforcements in metal matrices.

The mixing techniques of the present invention also serve to align the nanotubes and nanofibers, as well as to disperse them. The principles and techniques for aligning nanotubes by a process of shear flow, as well as the utility and potential end products are described in the related application PCT/US/00/33291, Nanofiber Continuous Fibers And Integrated Composites, hereby fully incorporated by reference.

Principles and techniques for manipulating nanotubes that are complementary to the present invention are known, for instance, functionalizing or derivatizing the metallic and semiconducting nanotubes along the tube wall can be used to ensure wetting. These processes are further described in the related application PCT/US99/21366 entitled: Chemical Derivation of Single Wall Carbon Nanotubes to Facilitate Solvation There of, and Use of Derivatized Nanotubes, hereby fully incorporated by reference.

With the need for advanced multifunctional materials nanotube filled metals will be of significant interest. The market potential is high since this method will insure manufacturing levels only limited by the availability of nanotubes and the speed at which this containerless process method can be scaled up. Materials have been made with metals with fullerenes and using aluminum, copper, or tin with multiwall or single wall nanotubes. The commercial impact for these materials is far reaching and range from aerospace to automotive, to structural, and home use.

This invention marks the opportunity to have developed metal systems taking advantage of the unique properties of dispersed nanotubes. Metal systems for multifunctional applications are of tremendous interest. Nanotubes offer the enhancement of metal systems for homogeneous or anisotropic use. Nanotubes will see a large number of applications but a significant number of them will require other material systems to be a component with them. This is apparent because although one of the sought after properties of a nanotube and more particularly pure SWNT, is the greatly increased strength. Consider a crystalline structure of aligned packed SWNT in the pure form However, for example, the shear strength between the different tubes is not great, and a composite or added material would then be stronger than the pure form. Crystalline nanotube systems may lead to high strength but it is expected that additional materials combined with the nanotubes or that provide bonding between the nanotubes for ensuring shear strength will likely be needed. In other engineering applications it might be desirable to provide a coating to protect the pure nanotubes, for instance for corrosion protection. This invention provides new material being developed by a new use of CP and will foster both the processing mode (CP) and the materials being developed (Metal systems with dispersed nanotubes).

BRIEF DESCRIPTION OF THE DRAWINGS

FIG. 7(*b*) shows the uniform particle sized microstructure of Cobalt-Tungsten Carbide with fullerenes with the absence of abnormal grain growth for cutting tool and hard surface applications.

FIG. 7(*c*) shows the finely dispersed fullerenes in the grain boundaries of polycrystalline nanostructured Iron for magnetic applications.

FIG. 8 shows an illustration of an Aluminum alloy matrix with traditional fiber reinforcement and a matrix enhanced by up to 5% SWNT.

FIG. 9(*a*) illustrates the rule of mixtures on the x axis the volume % of filler, and on the y axis on the left shows the strength of the matrix, and above that the strength of the improved matrix.

FIG. 9(*b*) similarly shows design possibilities for matrix fiber composite systems with high concentrations of SWNT

DETAILED DESCRIPTION OF PREFERRED EMBODIMENTS

Figure 1:
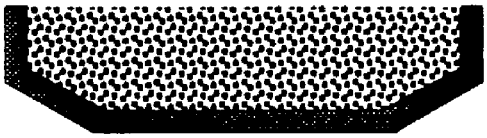
FIG. 1 shows a boat container of matrix material filled with fullerenes or nanofibers prior to levitation processing.

The present invention allows for the development of composite materials reinforced with single- and multi-walled nanotubes in order to produce materials that are lightweight, possess high strength and stiffness, and show improved composite toughness. A complementing aspect of the invention allows for tailoring the thermal and electrical properties of these nanotube derived materials, and processing and manufacturing parts using them.

The problems with infiltration of a metal with the nanotubes can be solved by fluid mixing that occurs in the electromagnetic levitation process. The invention addresses embedded nanotube dispersion, wettability, adhesion, and alignment issues in a matrix of metals. Functionalizing of the metallic and semiconducting nanotubes along the tube wall can be used to ensure wetting. A series of metals and alloy matrices including aluminum, copper, and tin have been processed with nanotubes to investigate the thermophysical properties of the melt mixture and the mechanical, thermal, and electrical properties of the resultant composites for manufacturing sample parts such as sheets and tubes. The production of the nanotubes embedded composite materials can be scaled up using a newly developed longitudinal electromagnetic levitator in addition to using the conical one.

Multifunctional materials which couple two or more functions of structural, electrical, thermal, and other properties are highly desirable. These multifunctional materials are needed over a wide temperature range and must therefore be processed in metal systems for low to intermediate temperature applications. Nanotubes are tubular molecules possessing mechanical, thermal, electrical, and other properties of significant interest that are utilized to achieve new multifunctional materials that were not previously available. While there is interest in developing nanotubes independent of other materials systems, there exists a great need to process nanotubes in various materials for advanced materials applications. Nanotube processing in polymers is at hand by high shear mixing and methods exist for processing ceramic materials with dispersed nanotubes although alignment has not readily been achieved. SWNTs and VGCFs have been dispersed and processed in zirconia ($ZrO_2$) at temperatures as high as 1100° C. with stable nanotubular features being observed. The present invention uses CP by electromagnetic or acoustic levitation to provide high degrees of shear flow of the metal matrix. The high degrees of shear mixing provide for nanotube agglomerates to break up and for metal infiltration to occur. The end result is a new composition of matter which is a metal part with highly dispersed nanotubes whether they are ropes, single nanotubes, or fullerenes. This process is also useful for vapor grown carbon fibers and multiwall nanotubes so all of the various nanofibers, including derivatized and functionalized nanotubes, can be processed into metals this way, provided the user considers nanofiber reactivity and starting conditions to control degrees of mixing and dispersion. In some cases, it is of interest that the nanotubes be reacted away to produce novel reinforcements that could not be produced by other means where nanotubes are used as a precursor system. The effect is to in situ create a "nanometal" new material by reacting the nanotubes with the metal and then to disperse the "nanometal" fiber evenly throughout the rest of the metal matrix. The resulting product will have different and unique properties compared to the precursor.

There are several different fillers such as fullerenes, nanotubes, and nanofibers that are available and suitable for use in the present invention. Those that are preferred are: VGCF (vapor grown carbon fiber), MWNT (multi-walled nanotubes), and SWNT (single walled nanotubes which in some cases are in "Ropes"). The SWNT's are the most useful in the present invention. They can be easily functionalized and derivatized for specialized use in the matrix.

There are several reasons for functionalizing or derivatizing the nanotube. Initially, compatibility is an issue. Functionalizing the nanotubes allows better incorporation into the matrix. In addition, the functionalized nanotubes can have enhanced properties that are desired in the final composition. A derivative is sometimes necessary to enhance the overall stability of the nanotube. For example, the ends may be "closed" (like a Buckyball—$C_{60}$) and thus are not completely carbon bonded as are those in the interior of the tube. One way of dealing with these closed ends is to create a derivative of the pure carbonaceous tube via a complex of the ends. The derivative nanotubes may enhance the system's ability to align the nanotubes in the matrix as well as adding to the overall structural stability of the system. Another way of dealing with the ends is simply to functionalize the ends. There are occasionally defective sites along the length of the tubes. (Usually more common in the MWNT than the SWNT.) Derivatives can be used to overcome these defective sites as well.

Figure 2:
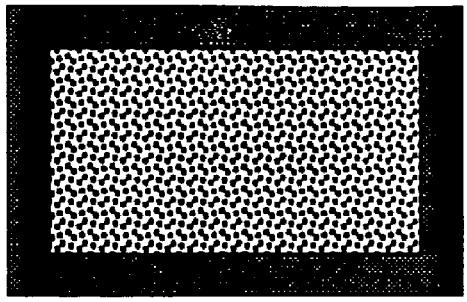
FIG. 2 shows a can container of matrix material filled with fullerenes or nanofibers prior to levitation processing.

According to one aspect of the present invention, a boat, FIG. 1, or can, FIG. 2, comprising the metal that is to form the matrix portion of the NRM is filled with a powder or other form of the nano-material that is to be dispersed in the matrix. The boat is placed within an electromagnetic levitator, conical or longitudinal as disclosed in U.S. Pat. No. 5,887,018, entitled "Longitudinal Electromagnetic Levitator,". When power is supplied to the levitator, it induces strong magnetic fields that levitate the metal object within the levitator. In addition, because of the rapidly reversing field direction, powerful eddy currents are induced in the sample. These eddy currents may be strong enough to cause effective dis-entanglement and dispersion of nanotubes in the metal matrix. While the metal of the boat or can melts and forms the matrix, the thermal energy in the system is not enough to disintegrate the nanotubes.

The temperature to which the levitated sample is heated during levitation and the period for which it is levitated can be controlled, making it possible to control the degree of nanotube dispersion. It is important to control temperature because if the temperature is maintained too high for too long, it is possible that reactions will occur between the nanotubes and the metal. In addition, generally with metals if the composite goes back into melt reactions are also possible that will change the characteristics of the composite. Generally polymers can go back into melt without this risk, (thermoplastics for example) if the components do not separate. In addition, other additives can be included in the can or boat and thereby mixed or alloyed into the final product.

The present technique can be used in a continuous or batch process. Likewise the can or boat comprising the matrix metal can take any other suitable form. The levitation can be done in a vacuum or in atmosphere, or in the presence of specific gasses chosen for the specific components being mixed. (Although of course the acoustic process would not work in a vacuum.) For the matrix material it is possible to use pure metals, alloys and polymers and epoxies. For the pure metal case, in atmosphere, when levitated and in the presence of nanotubes, as the metal melts, the nanotubes stick to the surface, and are homogeneously mixed by the eddy currents as melting is complete. Conditions of time, temperature, atmosphere, and pressure can be controlled to control the mix. The conditions and components may be varied and can be selected to achieve the desired end product. For instance the time and temperature will be chosen depending on the temperature needed to melt the matrix material, and the time to achieve the highly dispersed fill material, with the time and temperature both limited by the properties of the specific matrix and filler. It is also possible to achieve dispersion without alignment, for instance by mixing in a turbulent zone.

The matrix materials can be essentially any material that can be levitated, provided it is electrically conducting. The expected best materials are metals, and more specifically Iron, Aluminum, Titanium, Cobalt, and their alloys. The levitator coil can be shaped or the temperature conditions can be otherwise controlled to heat only certain zones, or the work piece can be cycled through a levitator or different levitators with different controls and in the presence of different matrix and filler materials progressively overcoating the product to create "onion layered" composites with layers of differing properties. Similarly the product can be fashioned under differing thermal conditions in different directions. Hybrid mixers combining electromagnetic and acoustic principles can be used as well. With the acoustic levitator the electrically conducting aspect May not be a limitation. Use of an acoustic levitator in microgravity or space applications permits additional conditions to vary.

Figure 3B:
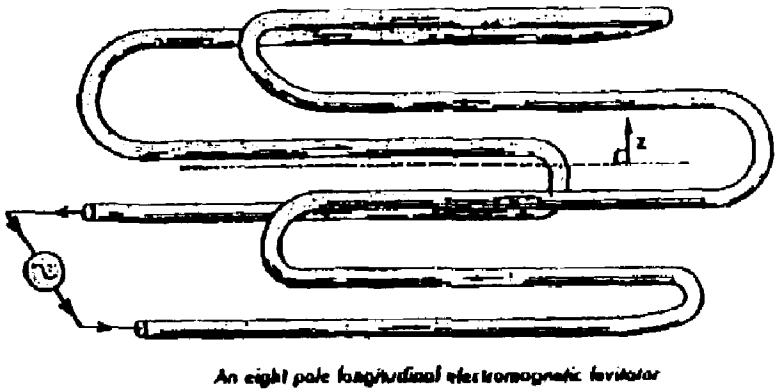
FIG. 3 shows (a) a conventional coil design and (b) a coil design developed in U.S. Pat. No. 5,887,018.
Figure 3A:
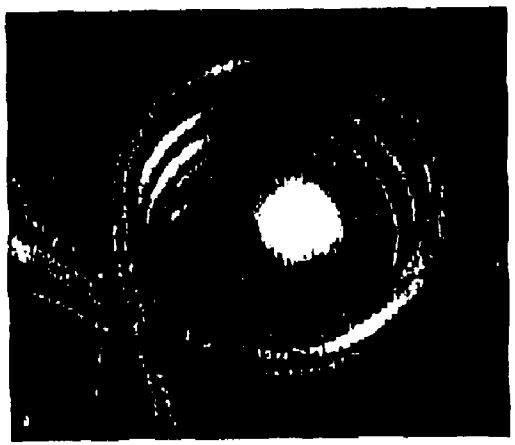

Using CP to form metals with dispersed nanotubes involves melting metals and alloys of interest in one of several options with nanotubes. Electromagnetic levitation is achieved when a metal or a conductor is put in a high frequency alternating electromagnetic field with a suitable coil geometry. Eddy currents induced in the metal produce supporting and stabilizing forces while simultaneously heating the metal, in some cases, to the point of melting. Therefore, the sample is held and melted in the absence of a solid container. Advantages of the process include: absence of physical contact with the sample, clean heating and melting, and the high potential for a homogeneous melt due to the efficient magnetic stirring. FIG. 3 shows (a) a conventional coil design and (b) a coil design developed in U.S. Pat. No. 5,887,018 which were used in this invention. CP provides a high degree of mixing, higher than that achieved in induction melting and stir casting. This high degree of mixing is used and May be required to disperse the nanotubes in the metal matrix. CP also has the advantage that the coil and manufacturing process can be designed to provide for alignment of the nanotubes where the induction melting and stir casting can not easily do this. Nanotubes interact with the metal flow to loosen from the tangled forms and become dispersed in the metal matrix.

Figure 4A:
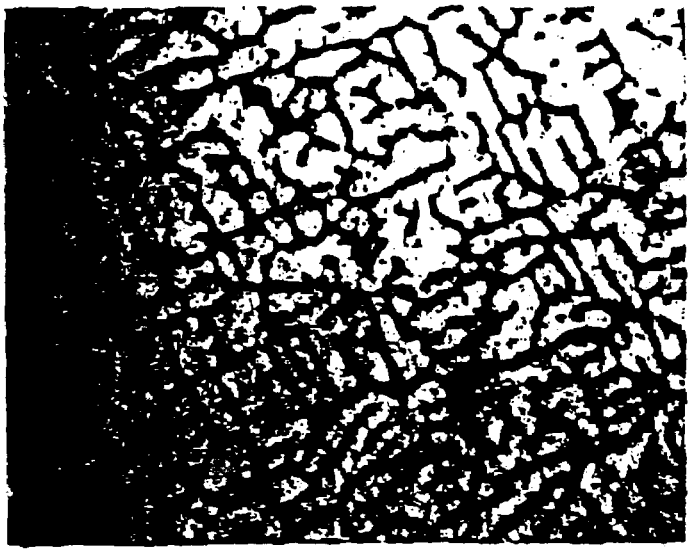
FIG. 4 shows micrographs of (a) a sample containerless processed without nanotubes and (b) one with nanotubes processed by CP.
Figure 4B:
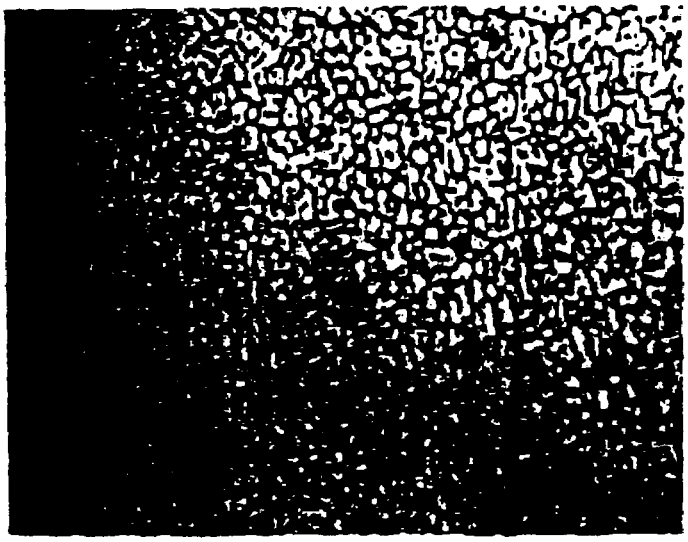

As a specific example, Aluminum from either a high purity source or alloy form is taken as a thin sheet. Pure aluminum is very ductile so it easily bends and can be folded to trap nanotubes inside. This sample is pressed to push out air and to reduce the void space, leaving an aluminum with nanotubes trapped inside the sample. The sample gets hung in the levitator coil of the containerless processor by a thin string. The connection between the string and sample is made using wax which melts and burns off without effecting the purity of the metal system. Coil design and degree of heating are controlled to provide for mixing with sufficient flow (turbulence) so that the nanotubes are dispersed. The levitator is turned off or the power is ramped down to let the molten sample began to solidify and drop into a quench tank or chill die (a die where a specific shape can be formed with controlled cooling). With this method of combining aluminum with nanotubes, the concentration can be controlled and the cost to process can be limited since powder metallurgical steps are not needed. In some cases, the initial steps before levitation may require other steps to assure good mixing and dispersion where the time of melt has to be limited. FIG. 4 shows micrographs of (a) a sample containerless processed without nanotubes and (b) one with nanotubes processed by CP.

Figure 5:
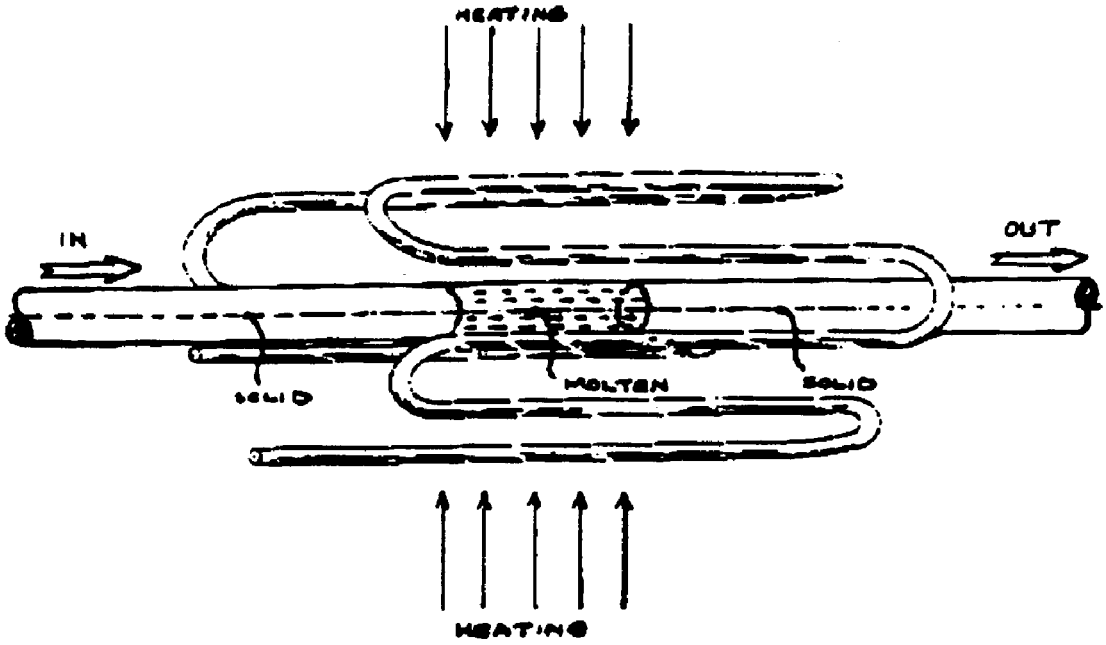
FIG. 5 shows the coil in operation with a sample rod continuously processed by passing through the electromagnetic field and with additional heat supplied to the melt zone.
Figure 6:
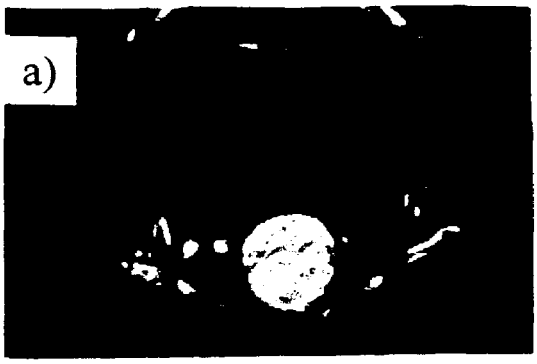
FIG. 6 shows the end of the coil.
Figure 7A:
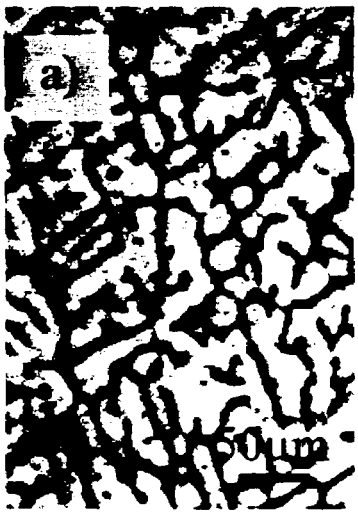
FIG. 7(*a*) shows an aluminum composite microstructure with nanotubes which was produced by electromagnetic levitation mixing for advanced composite materials applications.
Figure 7B:
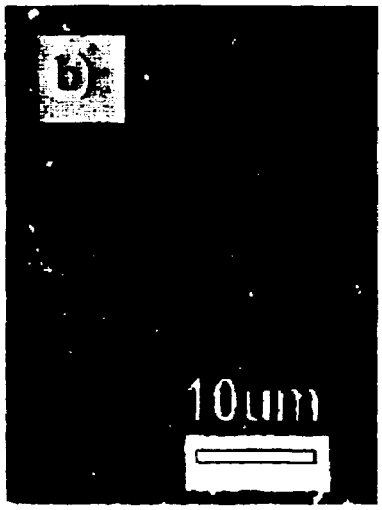
Figure 7C:
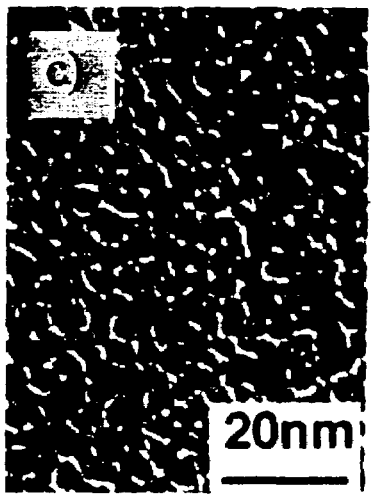

The levitator coil shown in FIG. 1(*b*) consists of a set of parallel conductors formed by bending copper tubing. FIG. 5 shows the coil in operation with a sample rod continuously processed by passing through the electromagnetic field and with additional heat supplied to the melt zone. The coil is capable of levitating large samples with high aspect ratios, provides maneuverability, and very good control of the position, temperature, and stirring of the sample. It allows for continuous feed of the specimen, levitating multiple specimens for alloying and moving them under control. The neighboring conductors pass current in opposite directions to levitate the metal or molten mass. FIG. 6 shows the end of the levitator coil. FIG. 7(*a*) shows an aluminum composite microstructure with nanotubes which was produced by electromagnetic levitation mixing for advanced composite materials applications. FIG. 7(*b*) and FIG. 7(*c*) show composites prepared by a deposition process for comparison. FIG. 7(*b*) shows the uniform particle sized microstructure of Cobalt-Tungsten Carbide with the absence of abnormal grain growth for cutting tool and hard surface applications. FIG. 7(*c*) shows the finely dispersed fullerenes in the grain boundaries of polycrystalline nanostructured Iron for magnetic applications (other ferromagnetic metals and alloys have also been used). The possibilities for enhancing materials properties by the levitation process of the present invention are apparent given the microstructural similarities of the uniform particle size and even distribution.

The shape of the levitator coil itself can also be modified, allowing parts to be cast out to shape or near to shape. The castings can also be machined down to size.

FIG. 8 shows an illustration of an Aluminum alloy matrix with traditional fiber reinforcement and a matrix enhanced by up to 5% SWNT. One aspect of the invention is to approach the design of advanced materials by enhancing the matrix in such fashion, with the improved metal now available for use in composites. FIGS. 9*a* and 9*b* illustrate this concept further, FIG. 9*a* is a graph illustrating on the x axis the volume % of filler, whether it is SWNT, MWNT, fullerenes or VGCF. The y axis on the left shows the strength of the matrix, and above that the strength of the improved matrix. FIG. 9*b* similarly shows design possibilities for matrix fiber composite systems with high concentrations of SWNT. Preferred concentrations for composite systems are from 10% to 60%, and within that range more commonly 20% to 25%. FIG. 9*b* shows design possibilities for composites possible by increasing the capabilities of the fibers on the right and for increasing the capabilities of the matrix on the left.

Low concentrations of the fullerene and nanotube fillers are expected to be less than 5 volume percent. Concentrations above this and generally around 10-25 volume % are considered reinforcing. Expectations are that volume fractions less that 60% will typically be considered of a composite level. Processing of materials with nanotubes up to 100% can occur provided the electrical conducting nature of the nanotubes is taken advantage of and that some small level of additional material is incorporated to hold them together. Fullerenes are semiconducting with a band gap of ~1.6 eV. SWNTs can be semiconducting or metallic. Since they can be electrical conducting the metal matrix does not have to be of the highest concentration.

The effective dispersion of the nanotubes is the key to the enhanced properties. The present invention provides a method that produces a homogeneous dispersion of the nanotubes in a matrix, overcoming the problems that are normally associated with dispersing nanotubes. More importantly, the matrix can be metals that are among the most difficult matrix components in which to achieve mixing. The present invention provides clear advantages as a practical and effective method for producing a homogeneous mixing or dispersion of nanotubes in a metal matrix. Further, and of equal significance, the process allows for the alignment of the nanotubes in the matrix if desired. This creates the possibility of enhanced properties through arranged packing of the matrix.

Utility

The utility of nanotube filled metals and improved composites is far-reaching. These commercial avenues impact the entire composite manufacturing industry. The applications for the NRM's are vast, reaching into the mechanical, electrical, and thermal fields of materials science. An example application could be electrical transmission wires, where enhanced properties of reducing thermal expansion and increasing strength could allow longer reaches between towers. Possible uses for the materials developed in this new application of CP include filled metals for electronic and thermal applications, structural composites, producing new alloys which are dispersion strengthened, and metal systems which are low radar observable materials. Specific applications include avionics racks, skin materials for aircraft, automobile side panels, sporting goods such as for golf or baseball, bicycle components and frames, truss members for high strength, thermal management components both microscale and macroscale, and multifunctional components for several dual use applications: structural/impact, structural/thermal, and structural electrical.

The filled matrices with improved properties of stiffness and strength can be formed into sheets, rods, tubes, truss members and other lightweight structures. Advanced materials made in accordance with the present invention include an Aluminum matrix with a nanotube filler (less than 5 wt %) for use with other processes to produce near net composite parts for particular use in manufacturing of large structural automotive components made of fiber reinforced metals or plastics. Metal matrix composite systems based on reinforcing nanotubes for electrical and mechanical applications can be made in accordance with the present invention.

It solves the problem of being able to mix and disperse nanotubes on the nano-scale so that a high degree of dispersion occurs without nanotube damage or with/without nanotube alteration, which ever is preferred. Since nanotubes are on the nano-scale and are available in tangled agglomerates, the ability to disperse them from the tangles and disperse them from each other has been of key interest. This use of CP provides for the high energy mixing necessary to achieve these goals.

This new use of electromagnetic levitation generates a melted mass that has significant motion in the melt that is dictated by the specific coil design. This is to say, sections of significant turbulence can be generated and altered by coil design and temperature control.

Near term applications will be in the area of small parts since the availability of nanotubes is low at this current time. Applications that could be realized in the future involve tremendous scale up of the levitation melting process and in turn the processing of large parts made of various metals with dispersed nanotubes.

As to the manner of operation and use of the present invention, the same is made apparent from the foregoing discussion. With respect to the above description, it is to be realized that although an enabling embodiment is disclosed, the enabling embodiment is illustrative, and the optimum relationships for the steps of the invention and calculations are to include variations in size, material, shape, form, function and manner of operation, assembly and use, which are deemed readily apparent to one skilled in the art in view of this disclosure, and all equivalent relationships to those illustrated in the drawings and encompassed in the specifications are intended to be encompassed by the present invention.

Therefore, the foregoing is considered as illustrative of the principles of the invention and since numerous modifications will readily occur to those skilled in the art, it is not desired to limit the invention to the exact construction and operation shown or described, and all suitable modifications and equivalents may be resorted to, falling within the scope of the invention.

What is claimed as being new and desired to be protected by Letters Patent is as follows:

1. A method for forming a composite of dispersed fullerenes in a matrix, comprising:

incorporating a plurality of fullerenes in a matrix, said incorporation forming a plurality of agglomerates; and uniformly distributing said fullerenes by exposing the agglomerates to heat and levitation; and aligning said fullerenes by shear flow during levitation.

2. The method of claim 1, wherein said fullerenes are single-walled nanotubes (SWNTs).

3. The method of claim 2 further comprising the step of derivatizing, functionalizing, or combinations thereof the SWNT prior to incorporating.

4. The method of claim 2 wherein the method is a batch process.

5. The method of claim 2 wherein the method is a continuous process.

6. The method of claim 2 wherein said matrix is metal.

7. The method of claim 2 wherein said matrix is polymer.

8. The method of claim 1 wherein said fullerenes are multi-walled nanotubes (MWNTs).

9. The method of claim 8 further comprising the step of derivatizing, functionalizing, or combinations thereof the MWNT prior to incorporating.

10. The method of claim 8 wherein said matrix is metal.

11. The method of claim 8 wherein said matrix is polymer.

12. The method of claim 1 wherein the method is a batch process.

13. The method of claim 1 wherein the method is a continuous process.

14. The method of claim 1 wherein said levitation is electromagnetic levitation.

15. The method of claim 14 wherein said fullerenes are single-walled nanotubes (SWNTs).

16. The method of claim 14 wherein said fullerenes are multi-walled nanotubes (MWNTs).

17. The method of claim 14 wherein said matrix is metal.

18. The method of claim 14 wherein said matrix is polymer.

19. The method of claim 14 further comprising the step of reacting said fullerenes with said matrix to form a component of hybrid fullerene-matrix fibers for distribution by said heat and levitation.

20. The method of claim 1 wherein said levitation is acoustic levitation.

21. The method of claim 20 wherein said fullerenes are a single-walled nanotube (SWNT).

22. The method of claim 20 wherein said fullerenes are a multi-walled nanotube (MWNT).

23. The method of claim 20 wherein said matrix is metal.

24. The method of claim 20 wherein said matrix is polymer.

25. The method of claim 20 further comprising the step of reacting said fullerenes with said matrix to form a component of hybrid fullerene-matrix fibers for distribution by said heat and levitation.

26. The method of claim 1 wherein said matrix is metal.

27. The method of claim 26 further comprising the step of reacting said fullerenes with said matrix to form a component of hybrid fullerene-matrix fibers for distribution by said heat and levitation.

28. The method of claim 1 wherein said matrix is a polymer.

29. The method of claim 28 further comprising the step of reacting said fullerenes with said matrix to form a component of hybrid fullerene-matrix fibers for distribution by said heat and levitation.

30. The method of claim 1 further comprising the step of reacting said fullerenes with said matrix to form a component of hybrid fullerene-matrix fibers for distribution by said heat and levitation.

31. The method of claim 30 wherein said fullerenes are single-walled nanotubes (SWNTs).

32. The method of claim 30 further comprising the step of aligning a single-walled nanotube (SWNT) and hybrid fullerene matrix fibers by shear flow during levitation.

33. The method of claim 30 further comprising the step of derivatizing, functionalizing, or combinations thereof the fullerenes prior to incorporating.

34. The method of claim 30 wherein said method is a batch process.

35. The method of claim 30 wherein said method is a continuous process.

36. The method of claim 1 further comprising the progressively recycling a work piece through the process to form an overcoated layered component.

37. The method of claim 36 wherein said fullerenes are single-walled nanotubes (SWNTs).

38. The method of claim 36 further comprising the step of aligning the single-walled nanotubes (SWNTs) and hybrid fullerene matrix fibers by shear flow during levitation.

39. The method of claim 36 further comprising the step of derivatizing, functionalizing, or combinations thereof the fullerenes prior to incorporating.

40. The method of claim 36 wherein said method is a batch process.

41. The method of claim 36 wherein said method is a continuous process.

42. A method for forming a composite of dispersed nanofibers in a matrix, comprising:

incorporating a plurality of nanofibers in a matrix, said incorporation forming a plurality of agglomerates; and uniformly distributing said nanofibers by exposing the agglomerates to heat and levitation; and aligning the nanofibers by shear flow during levitation.

43. The method of claim 42 wherein said nanofibers are vapor grown carbon fibers (VGCF).

44. The method of claim 42 wherein the method is a batch process.

45. The method of claim 42 wherein the method is a continuous process.

46. The method of claim 42 wherein said levitation is electromagnetic.

47. The method of claim 42 wherein said matrix is metal.

48. The method of claim 42 wherein said matrix is polymer.

49. The method of claim 42 further comprising the step of reacting said nanofibers with said matrix to form a component of hybrid matrix fibers for distribution by said heat and levitation.

50. A method for forming a nanocomposite of dispersed nanotubes in a matrix, comprising:

incorporating a quantity of nanotubes in a matrix, said nanotubes being in the form of a plurality of nanotube agglomerates; and uniformly distributing said nanotubes by exposing the nanotube agglomerates to mixing, wherein said mixing comprises containerless processing; and aligning the nanotubes by shear flow during said mixing.

51. The method of claim 50 wherein said nanotubes are selected from the group consisting of a single-walled nanotube (SWNT), a multi-walled nanotube (MWNT), and combinations thereof.

52. The method of claim 50 wherein said containerless processing comprises levitation.

53. The method of claim 52 wherein said levitation is selected from the group consisting of electromagnetic levitation, acoustic levitation, and combinations thereof.

54. The method of claim 52 wherein said containerless processing further comprises heating.

55. The method of claim 50 further comprising a step of derivatizing, functionalizing, or combinations thereof, the nanotubes prior to said mixing.

56. The method of claim 50 wherein the method comprises a batch process.

57. The method of claim 50 wherein the method comprises a continuous process.

58. The method of claim 50 wherein said matrix is selected from the group consisting of metals, alloys, polymers, epoxies, ceramics, and combinations thereof.

59. The method of claim 58 wherein said metals are selected from the group consisting of aluminum, iron, copper, tin, titanium, cobalt, tungsten, and combinations thereof.

60. The method of claim 50 wherein said matrix comprises an electrically conducting material.

61. The method of claim 50 wherein said matrix comprises polymer.

62. The method of claim 50 further comprising reacting said nanotubes with said matrix.

63. The method of claim 50 wherein said nanocomposite comprises multiple layers.

64. A method for forming a nanocomposite comprising dispersed fullerenes in a metal matrix, comprising:

incorporating a plurality of fullerenes in a metal matrix, said incorporating forming a plurality of agglomerates; and uniformly distributing said fullerenes by exposing the agglomerates to mixing; and aligning the fullerenes by shear flow during said mixing.

65. The method of claim 64 wherein said fullerenes are selected from the group consisting of a single-walled nanotube (SWNT), a multi-walled nanotube (MWNT), and combinations thereof.

66. The method of claim 65 wherein said fullerenes comprise a SWNT.

67. The method of claim 65 wherein said fullerenes comprise a MWNT.

68. The method of claim 64 wherein said mixing comprises containerless processing.

69. The method of claim 68 wherein said containerless processing comprises levitation.

70. The method of claim 69 wherein said levitation is selected from the group consisting of electromagnetic levitation, acoustic levitation, and combinations thereof.

71. The method of claim 69 wherein said containerless processing further comprises heating.

72. The method of claim 64 further comprising derivatizing, functionalizing, or combinations thereof the fullerenes prior to said mixing.

73. The method of claim 64 wherein the method comprises a batch process.

74. The method of claim 64 wherein the method comprises a continuous process.

75. The method of claim 64 wherein said metal is selected from the group consisting of aluminum, iron, copper, tin, titanium, cobalt, tungsten, and combinations thereof.

76. The method of claim 64 wherein said metal comprises an electrically conducting material.

77. The method of claim 64 wherein said metal comprises aluminum.

78. The method of claim 64 wherein said metal comprises copper.

79. The method of claim 64 further comprising reacting said fullerenes with said matrix to form a component of hybrid fullerene-matrix fibers for distribution by said mixing.

80. The method of claim 64 wherein said nanocomposite comprises multiple layers.

* * * * *